United States Patent [19]

Goller et al.

[11] Patent Number: 4,840,046

[45] Date of Patent: Jun. 20, 1989

[54] PROCEDURE AND DEVICE FOR ENSURING A PRECISELY POSITIONED INTRODUCTION OF A SUBSTITUTE YARN IN A KNITTING MACHINE

[75] Inventors: Ernst Goller, Reutlingen; Fritz Walker, Kusterdingen, both of Fed. Rep. of Germany

[73] Assignee: H. Stoll GmbH & Co., Fed. Rep. of Germany

[21] Appl. No.: 176,198

[22] Filed: Mar. 31, 1988

[30] Foreign Application Priority Data

Apr. 10, 1987 [DE] Fed. Rep. of Germany ..... 3712264

[51] Int. Cl.[4] ..... D04B 15/54

[52] U.S. Cl. ..... 66/144; 66/140 S; 66/127; 66/132 R

[58] Field of Search ..... 66/126, 127, 144, 125, 66/138, 140, 140 R, 140 S, 145 R, 145 S

[56] References Cited

U.S. PATENT DOCUMENTS

| | | | |
|---|---|---|---|
| 3,911,700 | 10/1975 | Tschumpelin | 66/127 |
| 3,962,891 | 6/1976 | Rouzaud | 66/132 |
| 4,111,007 | 9/1978 | Yokoyama | 66/127 |

*Primary Examiner*—Ronald Feldbaum
*Attorney, Agent, or Firm*—Larson and Taylor

[57] ABSTRACT

In the procedure for ensuring a precisely positioned introduction of a substitute yarn in a knitting machine by means of a substitute yarn (15) which is attached by a knotter (13) to a running yarn (12), the machine is halted at the desired position for the change of yarn before or after formation of the connecting knot (16) and afterwards the length of yarn located between the knotter (13) and the yarn working position is drawn out past the connecting knot (16) and taken up to one side and the machine is only started up again when the yarn feeder (11) is feeding the substitute yarn.

16 Claims, 3 Drawing Sheets

Figure 1:
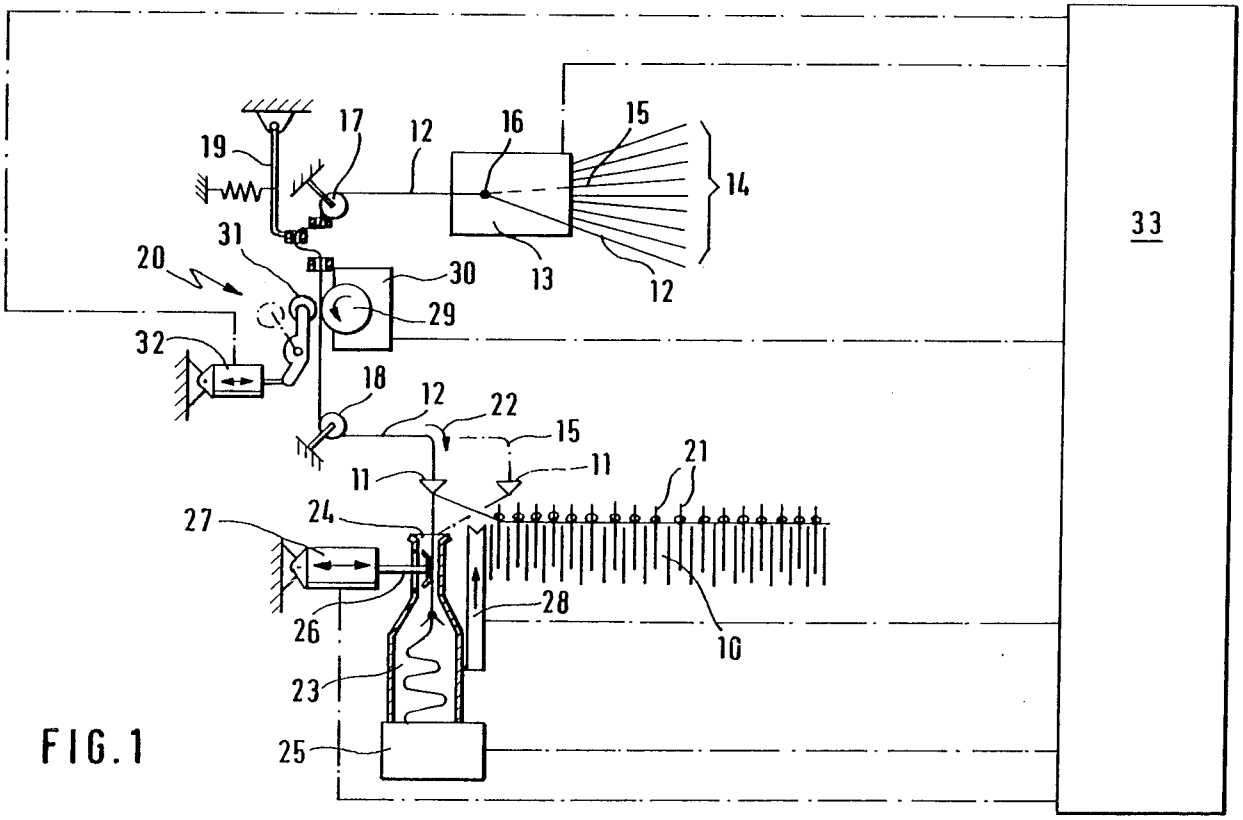

FIG.4
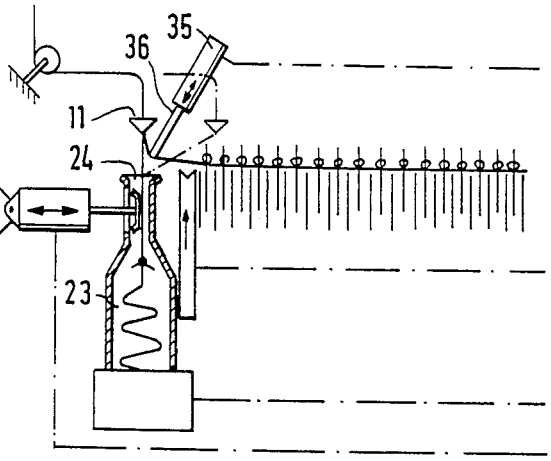
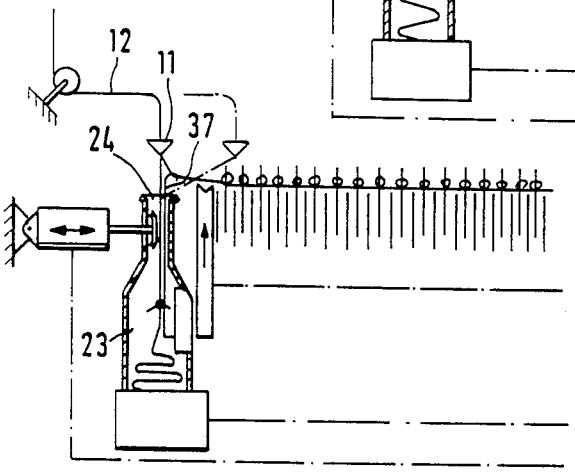
FIG.5
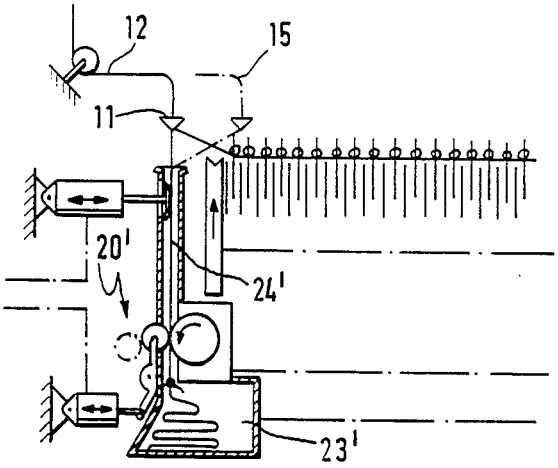
FIG.6

PROCEDURE AND DEVICE FOR ENSURING A PRECISELY POSITIONED INTRODUCTION OF A SUBSTITUTE YARN IN A KNITTING MACHINE

This invention relates to a procedure for ensuring a precisely positioned introduction of a substituite yarn in a knitting machine by means of a substitute yarn which it attached by splicing or knotting to a running yarn, and to a device for carrying out the procedure.

It is also known in knitting machines to construct yarn changing devices as knotting devices, in which a desired new yarn is knotted onto the old yarn whilst the machine is operating. However, there then exists the problem of locating the position of the knot, that is the change-over position between the old and the new yarn, exactly at that yarn working position at which a yarn changes, for example a colour change, in the knitting is to take place. Further, in modern electronically controlled knitting machines, a considerable expenditure on measurement and control would be necessary to acheive introduction of the substitute yarn at an exact needle position, which pre-supposes that the knot is so accurately formed at a predetermined time, that it allows stitches still to be formed with the old yarn exactly up to the knitting position at which a change-over to the new yarn, for example a substitute yarn of a different colour, is to take place.

The object of the invention is to provide a procedure and a device for carrying out this procedure, by which a precisely positioned introduction of a substitute yarn is ensured without expensive measuring procedures.

The object set forth is solved according to the invention in a procedure of the kind set out in the introduction in that after formation of the yarn connection the textile machine is halted at the desired yarn change position, the length of yarn between the splicing or knotting device and the yarn working position is drawn out beyond the yarn connection position, the drawn out section is prevented from pulling back by clamping, then the textile machine is started up again to work on the substitute yarn and finally the drawn out length of yarn is cut off and removed.

In the procedure according to the invention, a complicated advance calculation of the precise time of formation of the knot, so that the remaining old yarn can be worked exactly up to the position of yarn change-over in the knitting, is irrelevant and also an accompanying complicated measuring device can be dispensed with. It is sufficient if the knitting machine is halted for a short time at the desired position of yarn change-over in the knitting, which, in modern electronically controlled knitting machines, can already be achieved exactly to a needle anyway. The steps in the procedure thus take place in a short time with relatively small expenditure on control measures and devices and when the machine is started up again it is ensured that further operation is with the new yarn alone.

The device for carrying out the procedure according to the invention can be constructed in various ways. Advantageously, the device can have, on the yarn path between the yarn knotting device and the yarn working position, a yarn take-up device driven independently of the machine drive, and between the yarn feeder and the yarn working position a yarn collection container, a yarn clamp and a yarn cutting device, which are all connected to a control device. The remainder of the old yarn is not worked any more and is led to the yarn collection container, and operations are started again at once when the knotting position and the new yarn have arrived at the yarn feeder and the start of the new yarn is securely clamped so that no yarn is drawn back out of the yarn collection container and worked. As soon as the new yarn is bound into the knitting the discarded length of yarn located in the yarn storage container is cut off.

In the device constructed according to the invention, the cost of control is limited to starting up the knotter and a take-up device as soon as the knitting machine is shut off at the exact position, and operating the yarn taken up for so long that the knot which has been formed lies with certainty in the discarded length of yarn. In addition, the employment of a yarn locating member, the yarn clamp and the yarn cutting device have to be controlled. Advantageously, the yarn collection container can be maintained under reduced pressure, at least whilst the yarn is being taken up, so that the length of yarn which is drawn off is drawn into the yarn collection container, when it is brought into the suction region, suitably beforehand, by means of the yarn locating member, for example, a plunger which can be introduced into the collection container inlet, an entry tube which can be moved up to the yarn feeder, a hook which can be drawn into the collection container, or by the yarn feeder itself moving into the collection container inlet.

The yarn take-up device can suitably have a drive roller coupled to a length measuring device and can be located, with respect to the direction of movement of the yarn, either before or after the yarn feeder and can act on the length of yarn to be discarded.

There will be described below in greater detail with reference to the accompanying schematic drawing embodiments of a device for carrying out the procedure on a flat knitting machine.

Figure 2:
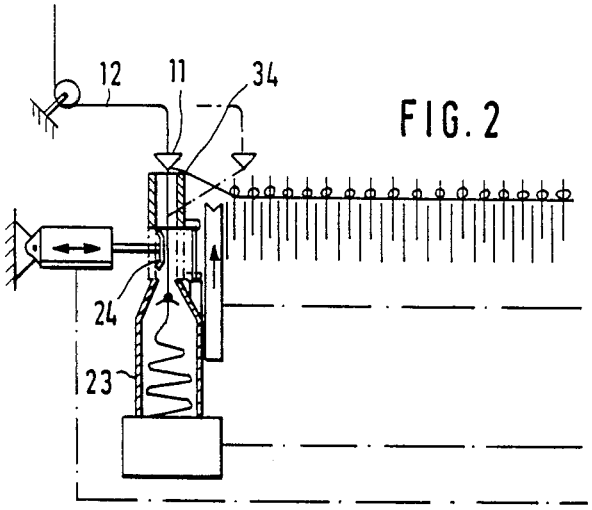
Figure 3:
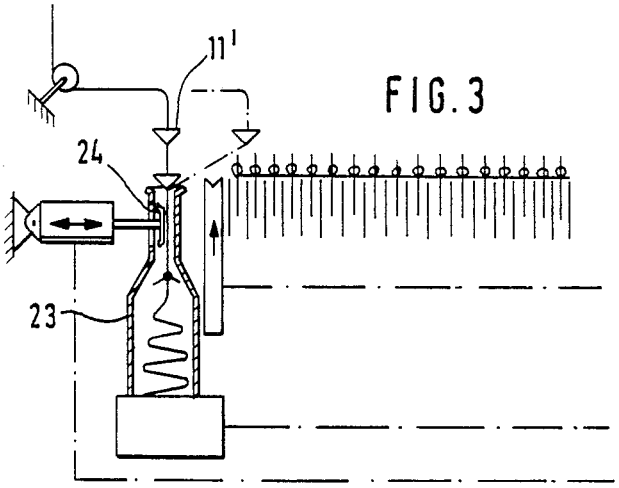

In detail there is shown in:

FIG. 1 a schematic representation of a first embodiment of the device;

FIG. 2 a partial representation of a second embodiment;

FIG. 3 a partial representation of a third embodiment;

FIG. 4 a partial representation of a fourth embodiment;

FIG. 5 a partial representation of a fifth embodiment;

FIG. 6 a partial representation of a sixth embodiment of the device;

The schematic representation of FIG. 1 shows the end section of a needle bed 10 of a flat knitting machine and a yarn feeder 11 to which a yarn 12 is guided from a knotter 13. There is guided to the knotter a whole bunch of yarns, which may be the same or different, here, for example, nine yarns of different colour, one of which is the running yarn 12 to which selectively at any time one of the other eight yarns can be connected as a substitute yarn 15. The connecting knot is indicated with the reference numeral 16.

From the knotter 13 the running yarn 12, that is the yarn in use at the time from the bunch of yarns 14, is forwarded over guide rollers 17, 18, a yarn tensioner in the form of a spring loaded pivoted arm 19 and over a yarn takeup device 20 to the yarn feeder 11. The yarn feeder is moved in known manner by the cam carriage of the flat knitting machine, not shown, and presents the running yarn 12 to the needles 21 of the needle bed 10, also in known manner.

Included in the device for ensuring a precisely located introduction of a substitute yarn, in addition to the yarn take-up device 20, is a yarn collection container 23 located after the yarn feeder 11 in the direction of movement of the yarn indicated by an arrow 22 and having an inlet opening 24, which is connected to a suction fan 25. In the inlet opening 24 is located a yarn clamp 26, which is operable, for example, by means of a pneumatic piston and cylinder device 27. Near the yarn collection container 23 there is located at the end of the needle bed 10 a yarn cutting device 28. The yarn take-up device 20 has a drive roller 29, which is coupled to a length measuring device, not shown in detail, and is provided with its own drive motor 30. A counter-pressure roller 31 co-operates with the drive roller and is movable, for example by means of a pneumatic piston and cylinder device 32 out of the drive position shown in FIG. 1 to a raised position or vice versa.

The knotter 13, the yarn take-up device 20 with its drive motor 30 and the piston and cylinder device 32, the suction fan 25, the piston and cylinder device 27 for the yarn clamp 26 and the yarn cutting device 28 are coupled to a control device 33, as shown by thick chain-dotted lines in the drawing.

If, for example, in a flat knitting machine the next course is to be knitted in a different colour, the control device 33 brings about the connection of the desired substitute yarn 15 to the running yarn 12 in the knotter 15 whilst the yarn feeder 11 is still moving to its end position at the end of the needle bed, shown in FIG. 1. As soon as the knitting of the last stitch of the current course has been completed, the textile machine is shut off by the control device 33 in the end position of the yarn feeder 11 and the drive motor 30 for the drive roller 29 as well as the piston and cylinder device 32 for the counter pressure roller 31 of the yarn take-up device 20 are operated whereby the running yarn 12 with the connecting knot 16 and the substitute yarn 15 connected to it are transported further to the yarn feeder 11. From the yarn feeder 11 the positively forwarded running yarn 12 falls into the inlet opening 24 of the yarn collection container 23 and is sucked into the yarn collection container 23 through the inlet opening 24 by the reduced pressure produced in the yarn collection container 23 by the suction fan 25, also under control. The length measuring device connected to the drive roller 29 allows the yarn take-up device to remain switched on for a length of time such that the whole length of the running yarn 12 located between the yarn feeder 11 and the knotter 13, the connecting knot 16 and additionally also the start of the substitute yarn 15 are further guided to the yarn collection container 23. The yarn take-up device 20 is then switched off and the substitute yarn 15 now to be found there is left unencumbered by the pivoting away of the counter pressure roller 31. The control device 33 operates the yarn clamp 26 so that the length of yarn introduced into the yarn collection container 23 is secured against being pulled back out of the inlet opening 24, before the machine is switched on again and the yarn feeder 11 begins its movement to the right for the formation of the next course of stitches, now with the substitute yarn 15. As soon as the substitute yarn 13 has been knitted by a few needles 21, the control device 33 sets the yarn cutting device 28 in operation and cuts off the old yarn 12 at the edge of the knitting.

FIG. 2 shows an embodiment in which there is located in the region of the inlet opening 24 of the yarn collection container 23 a yarn locating device in the form of an inlet tube 34, which can be moved up to the yarn feeder 11. By means of this yarn locating device, the sucking in of the length of yarn to be discarded in the yarn collection container and which runs through the yarn feeder 11 is facilitated.

In the embodiment of FIG. 3, the yarn feeder 11' itself forms the yarn locating member, in that it can be lowered into the inlet opening 24 of the yarn collection container 23.

In the embodiment of FIG. 4, a yarn location device 35 controlled by the control device is provided with a plunger 36 by which the yarn emerging from the yarn feeder 11 is brought into the region of the inlet opening 24 of the yarn collection container 23 at which a suction effect is maintained.

In the embodiment of FIG. 5, a take-down hook 37 projecting through the inlet opening 24 of the yarn collection container 23 to the outside is provided, with which the yarn emerging from the yarn feeder 11 can be grasped and pulled into the suction region of the inlet opening 24.

In the embodiment of FIG. 6, the yarn take-up device 20' is located after the yarn feeder 11 in the region of the yarn collection container 23' in contrast to the embodiment of FIG. 1. The yarn is forwarded to the yarn take-up device 20' through a long yarn entry duct 24' by the suction effect of the reduced pressure prevailing in the yarn collection container 23' so that additionally one of the yarn locating members known from FIGS. 2 to 5 can also be used.

Instead of the knotter 13 a yarn splicing device can be provided for connection of a substitute yarn 15 with the running yarn 12. The use of the device is not restricted to flat knitting machines. It is not necessary to use as the yarn take-up device 20, 20' a device with a drive roller 29 but there can also be employed devices constructed differently, which can impart a positive take-up motion to the yarn 12.

What is claimed:

1. A method for ensuring a precisely positioned introduction of a substitute yarn in a knitting machine of the type wherein the substitute yarn is attached to a running yarn, comprising the steps of:

before or after formation of the yarn connection, halting the knitting machine at the time when it is desired to change a yarn, drawing out a length of yarn between the yarn attachment position and the yarn working position, clamping the drawn out yarn to prevent its being pulled back, restarting the knitting machine to work the substitute yarn, and cutting off and removing the drawn out length of yarn.

2. A method according to claim 1, wherein the attachment is by splicing.

3. A method according to claim 1, wherein the attachment is by knotting.

4. An apparatus for ensuring a precisely positioned introduction of a substitute yarn on a knitting machine having at least one yarn feeder in the region of the yarn working position, to which the yarn is guided selectively from several yarn storage bobbins through a yarn changing device, characterized in that there is provided on the yarn path between the yarn changing device and the yarn working position a yarn take-up device, means for driving the yarn take-up device independently of the knitting machine drive, and including a yarn collection container between the yarn feeder and the yarn working position, a yarn clamp for clamping the yarn in the yarn collection container and a yarn cutting device for cutting a drawn out length of yarn, and including a control device for controlling operation of the yarn take-up device the yarn collection container, the yarn clamp and the yarn cutting device.

5. An apparatus according to claim 1, wherein the yarn changing device is a yarn splicing device.

6. An apparatus according to claim 1, wherein the yarn changing device is a yarn knotting device.

7. A device according to claim 4 including means for maintaining the yarn collection container (23) at reduced pressure at least during the yarn take-up.

8. A device according to claim 4, characterised in that there is associated with the yarn collection container (23) at least one moveable yarn location member (36, 37) for introducing the length of yarn to be removed into the inlet opening (24) of the yarn collection container (23).

9. A device according to claim 8, characterised in that the yarn location member is a plunger which can descend into the inlet opening (24) of the collection container.

10. A device according to claim 8, characterised in that the yarn location member is a take-down hook (37) for catching the yarn (12), which can be drawn into the inlet opening (24) of the collection container.

11. A device according to claim 4, characterised in that the yarn clamp (26) is located in the inlet opening (24) of the collection container.

12. A device according to claim 4, characterised in that the yarn take-up device (20) has a drive roller (29) coupled to a length measuring device.

13. A device according to claim 4, characterised in that the yarn take-up device (20) is located before the yarn feeder (11) in the direction of yarn movement.

14. A device according to claim 4, characterised in that the yarn take-up device (20') is located behind the yarn feeder (11) in the direction of yarn movement.

15. A device according to claim 4, characterised in that the yarn feeder (11') is additionally formed as a yarn location member.

16. A device according to claim 8, characterised in that the yarn location member is an inlet tube which can be moved up to the yarn feeder (11).

* * * * *